US012338618B2

(12) United States Patent
Wang

(10) Patent No.: US 12,338,618 B2
(45) Date of Patent: Jun. 24, 2025

(54) OUTDOOR FRAMING MODULE

(71) Applicant: PAVCY LLC, Holladay, UT (US)

(72) Inventor: Zhian Wang, Holladay, UT (US)

(73) Assignee: PAVCY LLC, Holladay, UT (US)

( * ) Notice: Subject to any disclaimer, the term of this patent is extended or adjusted under 35 U.S.C. 154(b) by 312 days.

(21) Appl. No.: 18/116,494

(22) Filed: Mar. 2, 2023

(65) Prior Publication Data

US 2024/0295113 A1 Sep. 5, 2024

(51) Int. Cl.
*E04B 1/26* (2006.01)

(52) U.S. Cl.
CPC ..... *E04B 1/2608* (2013.01); *E04B 2001/266* (2013.01)

(58) Field of Classification Search
CPC ..... E04B 1/2608; E04B 2001/266
See application file for complete search history.

(56) References Cited

U.S. PATENT DOCUMENTS 2,611,160 A * 9/1952 Hanesse ..... A63H 33/107 182/228.1
2,879,087 A * 3/1959 Haglund ..... E04G 7/14 D8/382
3,392,947 A * 7/1968 Keliehor ..... A47C 5/04 403/174
3,586,359 A * 6/1971 Cecelski ..... E04B 1/58 403/219
4,196,556 A * 4/1980 Russo ..... E04B 1/2608 52/285.3
D256,663 S 9/1980 Gilb
D258,344 S * 2/1981 Hornung ..... D8/380
4,355,725 A * 10/1982 Humphrey ..... E04B 1/2604 211/49.1
4,885,883 A 12/1989 Wright
5,653,079 A * 8/1997 Loeffler ..... E04C 3/16 52/715
5,732,524 A * 3/1998 Kalker, Jr ..... E04B 1/2608 52/712
6,094,880 A * 8/2000 Thompson ..... E04B 1/2608 52/715
6,625,944 B2 * 9/2003 Mackay ..... E04B 1/2604 52/261
6,810,628 B2 * 11/2004 Emms ..... E04C 3/40 52/93.2

(Continued)

*Primary Examiner* — Rodney Mintz
(74) *Attorney, Agent, or Firm* — Thorpe North & Western, LLP

(57) ABSTRACT

An outdoor framing module to connect a beam to a post. A pair of modules are combinable in an inverse orientation. The module has first and second receivers affixed to one another and oriented perpendicular to one another. The first receiver being a blind receiver to capture the horizontal beam. The first receiver having a first opening, a first perimeter collar, and a first vertical dimension across. The second receiver being a through receiver directly affixed to the first receiver to capture the vertical post. The second receiver having opposite openings spaced-apart from one another, a second perimeter collar, and a second vertical dimension less than the first dimension. One of the opposite openings being positioned flush with a side of the first perimeter collar of the first blind receiver and the other opposite opening being positioned intermediate opposite sides of the first perimeter collar of the first blind receiver.

20 Claims, 11 Drawing Sheets

(56) References Cited

U.S. PATENT DOCUMENTS

| | | | | |
|---|---|---|---|---|
| 8,225,575 | B2 | 7/2012 | Gadd et al. | |
| D887,025 | S | 6/2020 | Styrc et al. | |
| 10,858,819 | B2 | 12/2020 | Styrc et al. | |
| D929,611 | S | 8/2021 | Styrc et al. | |
| 11,118,349 | B2 | 9/2021 | Montoya et al. | |
| D937,444 | S | 11/2021 | Styrc et al. | |
| 11,174,630 | B2 * | 11/2021 | Bowron | E04B 1/2604 |
| 11,214,954 | B2 | 1/2022 | Styrc et al. | |
| 11,236,503 | B2 | 2/2022 | Fox | |
| 2003/0031077 | A1 * | 2/2003 | Emms | E04C 3/40<br>365/230.03 |
| 2003/0079427 | A1 * | 5/2003 | Mackay | E04B 1/2604<br>52/261 |
| 2010/0175344 | A1 * | 7/2010 | Gadd | E04B 1/2608<br>52/655.1 |
| 2017/0089059 | A1 * | 3/2017 | Farre Berga | E04B 1/1912 |
| 2018/0135295 | A1 * | 5/2018 | Bowron | E04B 1/2604 |
| 2019/0376272 | A1 * | 12/2019 | Styrc | A45F 3/24 |
| 2020/0199861 | A1 * | 6/2020 | Fox | E04B 1/2604 |
| 2020/0240130 | A1 * | 7/2020 | Styrc | E04F 10/08 |
| 2021/0017756 | A1 * | 1/2021 | Russel | E04B 1/2604 |
| 2021/0230870 | A1 * | 7/2021 | Montoya | E04B 1/2608 |

* cited by examiner

OUTDOOR FRAMING MODULE

BACKGROUND

Traditional outdoor framing work, such as pergolas, can be complicated and may require professional building knowledge and technique. The works may also utilize many different types of hardware to fulfill different structure configurations. The multitude of hardware can lead to inventory difficulty, long built time, and high costs.

For example, traditional outdoor framing work can require various hardware fixtures to secure lumber in different configurations. The variety of hardware fixtures can increase the complexity of the work and can require material inventory management. In addition, traditional framing hardware can be aesthetically displeasing and may require additional work and hardware to cover and hide.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
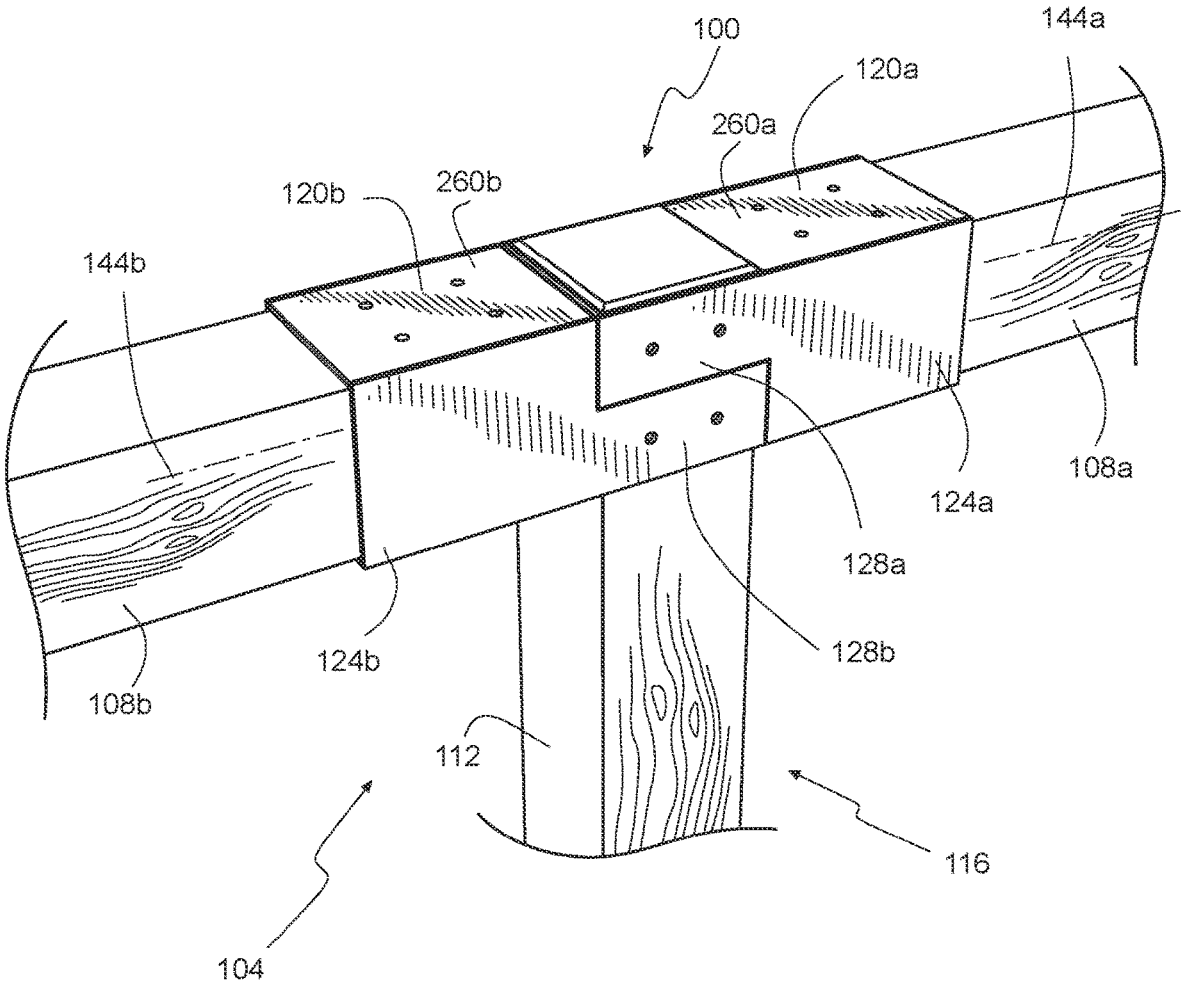
FIG. 1 is a perspective view of a joint of an outdoor structure with a pair of outdoor building modules in an embodiment of the invention showing a vertical post and a pair of horizontal beams in an aligned configuration.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

The invention presents an outdoor framing module that can attach a horizontal beam to a vertical post to form a joint of an outdoor structure, such as a pergola, a pavilion, a panel, a fence, etc. The module can have a horizontal receiver with an opening to receive an end of the horizontal beam. The module can also have a vertical through receiver with opposite openings to receive the vertical post. The openings can have a geometry and size to fit common building lumber sizes, such as 6"×6", 4"×4", etc.

In one aspect, at least two modules can be combined to connect and fix multiple beams and posts in up to six directions. The modules can have a symmetric design that can be inverted with respect to one another and nested with one another. The through receivers of two modules can nest together to attach multiple beams to a common post.

The design of the module can reduce construction complexity, increase building accuracy and speed-up the building process. The modules can have pre-drill holes to receive standard fasteners, such as screws and bolts.

The design of the module can provide a system with a single design (for a given lumber size) so that multiple identical modules can be used to form all the joints of the outdoor structure to lower merchandise inventory quantities, and reduce design and order complexity. A single module design can accommodate multiple aspects of multiple outdoor structures. Thus, only a single module design may need to be stocked.

In addition, the modules can be designed for outdoor construction environments. The modules can be formed of coated galvanized steel to resist rust. In addition, the modules can be strong to hold the post and the beams and to provide structural rigidity. The modules can be formed of 11-gauge carbon steel sheet welded together.

In another aspect, the modules can be provided in at least two different sizes. One size can fit a cross-sectional width up to four inches, for example a 4×4 post and beam. Another size can fit a cross-sectional width up to 6 inches, such as 6×6 post and beam. Other sizes may be provided to accommodate different cross-sections, such as 6×4, 6×2, 4×2, etc.

The modules can make framing building structures simpler, even for non-professionals. The symmetric design of the module can accommodate different structural configurations. The modules can accommodate common post and beam materials, shapes and sizes. Thus, a builder does not need to determine multiple different kinds of hardware for the job or structure. The modules can make it easier to estimate the right amount of hardware for the building plan. The modules can also benefit merchandising by lowering the management complexity.

Referring to FIG. 1, an example of a joint 100 of an outdoor framing system 104 is shown connecting a pair of horizontal beams 108*a* and 108*b* to a vertical post 112 as part of an outdoor structure 116. The system 104 can comprise a pair of identical outdoor framing modules 120*a* and 120*b* to connect the beams 108*a* and 108*b* and the post 112 together.

Figure 2:
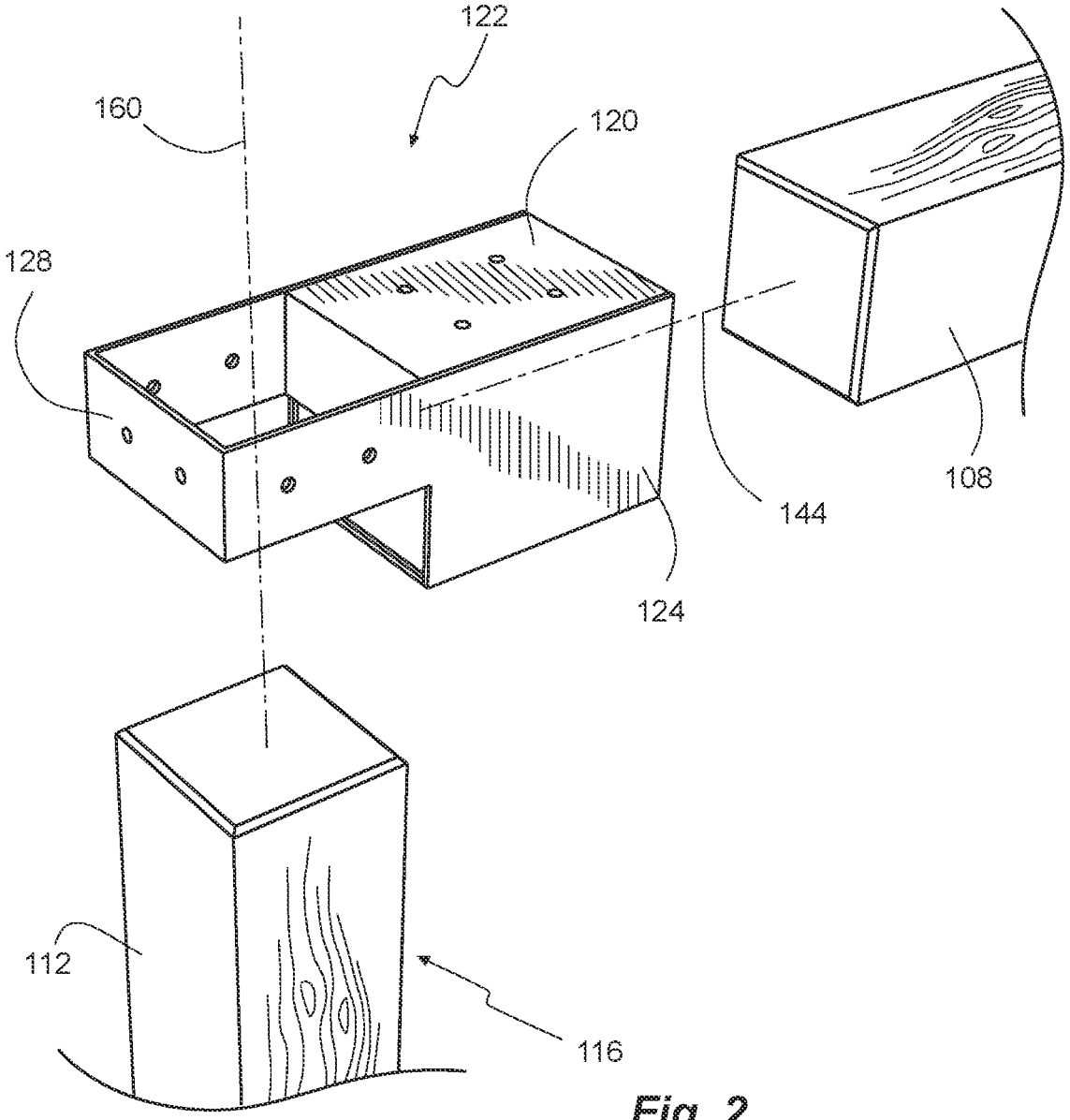
FIG. 2 is an exploded perspective view of another joint with the outdoor building module of FIG. 1 shown with a horizontal beam and the vertical post.
Figure 3:
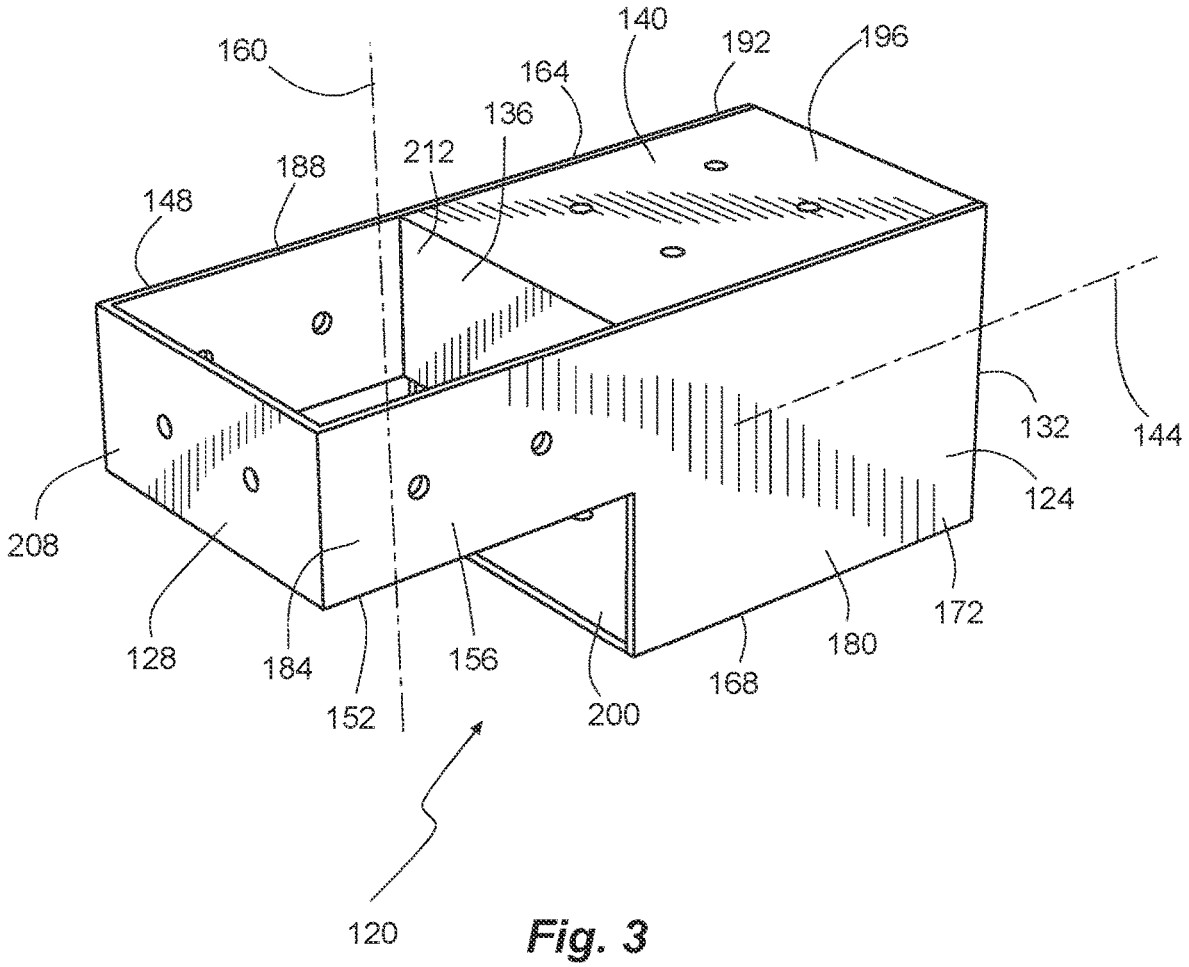
FIG. 3 is a perspective view of the outdoor building module of FIG. 1.

Referring to FIG. 2, another example of a joint 122 is shown with the module 120 for attaching the beam 108 and the post 112 together in a perpendicular orientation. An end of the beam 108 can be captured by the module 120. An end of the post 112 can be captured by the module 120. Fasteners, such as screws, can extend through preformed apertures in the module 120 to secure the beam 108 and the post 112.

Referring to FIGS. 1-10, an example of an outdoor framing module 120 is shown. The module 120 can have a pair of receivers, such as first and second receivers 124 and 128. The first receiver 124 can be a blind receiver while the second receiver 128 can be a through receiver. The pair of receivers 124 and 128 can be affixed to one another and oriented perpendicular with respect to one another. The receivers 124 and 128 can share a single unified body. The receivers 124 and 128 can receive the beam 108 and the post 112 in a perpendicular orientation, as shown in FIGS. 1 and 2. The first blind receiver 124 can receive the horizontal beam 108 while the second through receiver 128 can receive the vertical post 112. The first blind receiver 124 can capture an end of the beam 108 and the second through receiver 128 can capture the post 112.

The first blind receiver 124 can have a first opening 132 to receive the end of the beam 108. In one aspect, the first opening 132 can be planar and vertically oriented. In another aspect, the first opening 132 can have a square shape to match a square cross-sectional shape of the beam 108. The first blind receiver 124 can have a terminus 136 spaced-apart from and opposite the first opening 132 to abut to the end of the beam 108. The terminus 136 can resist the beam 108 from interfering with the second receiver 128. A first perimeter collar 140 can extend at least partially around the first opening 132, and can extend between the first opening 132 and the terminus 136. In one aspect, the first perimeter collar 140 can be continuous around a circumference of first opening 132, the terminus 136 and the blind receiver 124. The first blind receiver 124 can have a horizontal axis 144 extending through the first perimeter collar 140, and between the first opening 132 and the terminus 136. The first blind receiver 124 can also have a first dimension d1 (FIGS. 6 and 8) across the first perimeter collar 140 and transverse to the horizontal axis 144. The first dimension d1 can be a vertical dimension.

The second through receiver 128 can be directly and rigidly affixed to the first blind receiver 124. The second through receiver 128 can have opposite second and third openings 148 and 152 aligned and spaced-apart from one another. In one aspect, the openings 148 and 152 of the second through receiver 128 can be planar and oriented horizontally. In another aspect, the openings 148 and 152 of the second through receiver 128 can be oriented parallel with respect to one another. A second perimeter collar 156 can extend between the second and third openings 148 and 152. In one aspect, the second perimeter collar 156 can be continuous around a circumference of the openings 148 and 152 and the second through receiver 128. The terminus 136 can form a portion of the second perimeter collar 156. The second through receiver 128 can have a vertical axis 160 through the opposite second and third openings 148 and 152. The vertical axis 160 can be perpendicular to the horizontal axis 144 of the first blind receiver 124. The second through receiver 128 can also have a second dimension d2 (FIGS. 6 and 8) between the second and third openings 148 and 152. The second dimension d2 can be a vertical dimension and can be parallel with the first dimension d1 of the first blind receiver 124.

Figure 13:
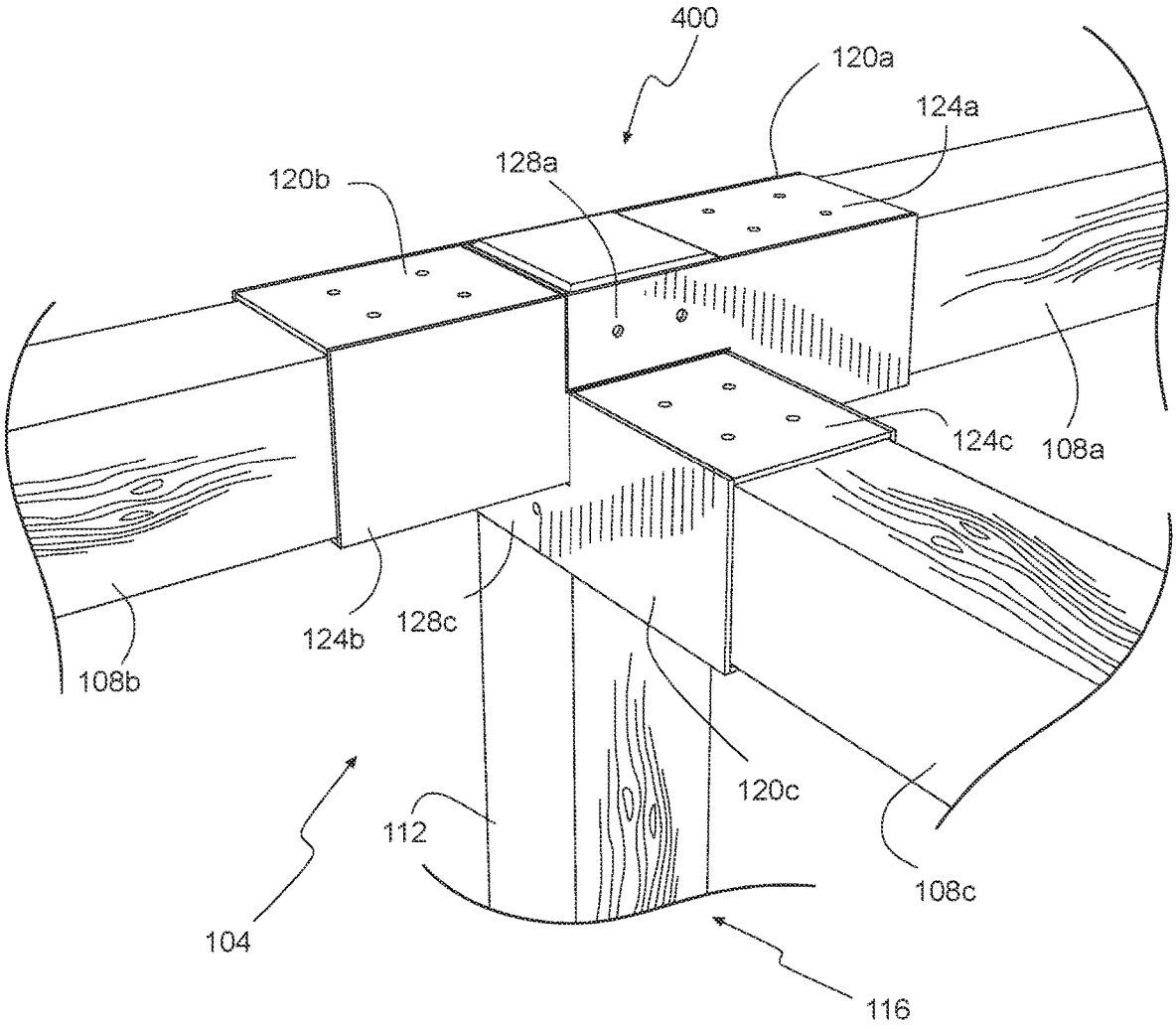
FIG. 13 is a perspective view of another joint of an outdoor structure in another embodiment of the invention showing three outdoor building modules of FIG. 1 with the vertical post and three horizontal beams.
Figure 14:
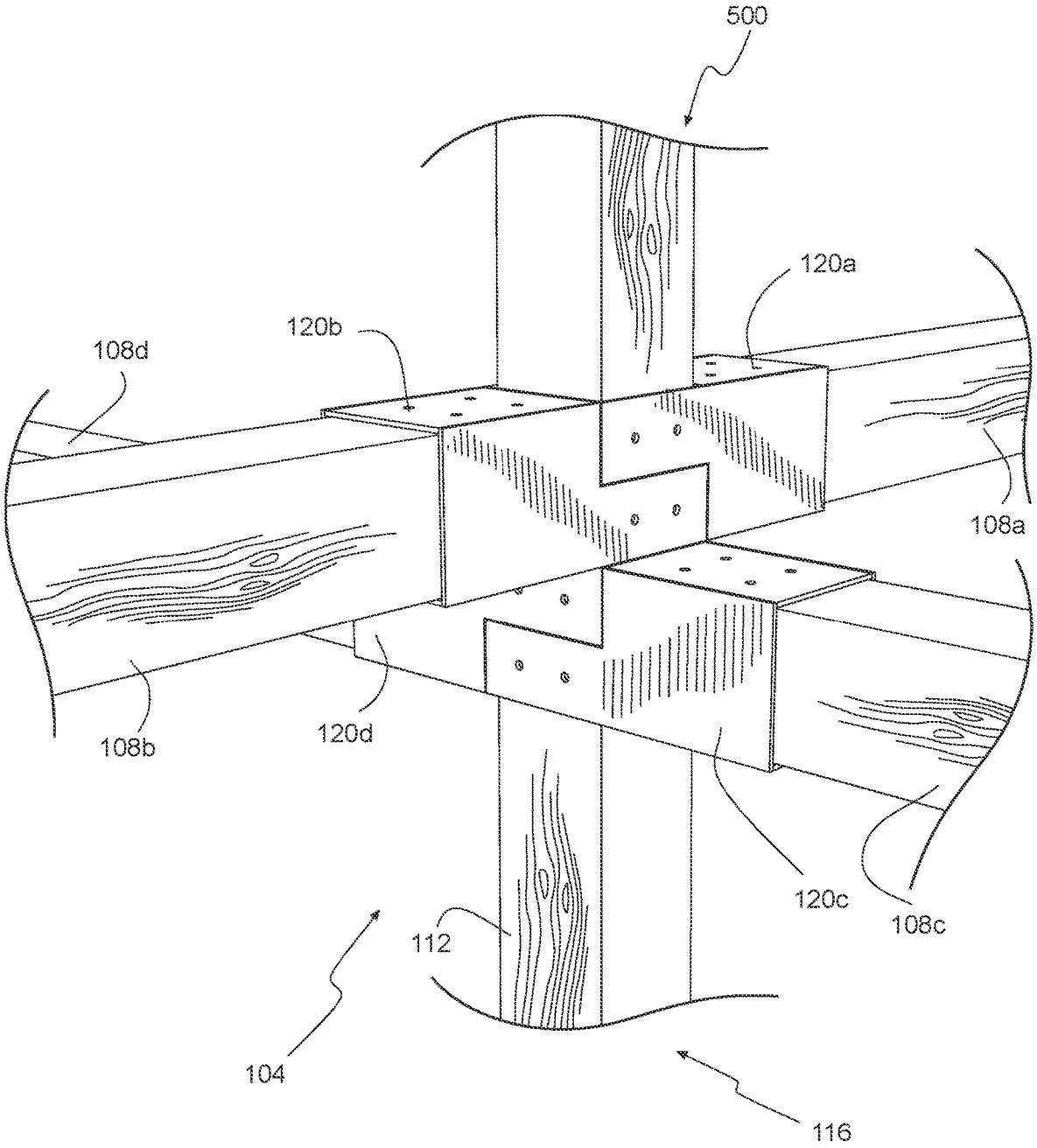
FIG. 14 is a perspective view of another joint of an outdoor structure in another embodiment of the invention with four outdoor building modules of FIG. 1 with the vertical post and four horizontal beams.

The second dimension d2 of the second through receiver 128 can be less than (d2<d1) the first dimension d1 of the first blind receiver 124. In one aspect, the second dimension d2 can be half of (d2=d½) the first dimension d1. The second through receiver 128 can be positioned to one side of the first blind receiver 124. The second opening 148 of the second through receiver 128 can be positioned flush, coplaner and on a same level with a top or bottom side 164 or 168 of the first perimeter collar 140 of the first blind receiver 124. The top and bottom sides 164 and 168 can be vertically positioned and horizontally oriented. The third opening 152 of the second through receiver 128 can be positioned intermediate opposite top and bottom sides 164 and 168 of the first perimeter collar 140 of the first blind receiver 124. A longitudinal thickness d2 of the through receiver 128 can be less than a vertical thickness d1 of the blind receiver 124. Thus, the second through receivers 128*a* and 128*b* of a pair of modules 120*a* and 120*b* can nest together when inverted with respect to one another and aligned with respect to one another, as shown in FIG. 1. In addition, the through receivers 128*a* and 128*b* of the pair of modules 120*a* and 120*b* can together circumscribe the vertical post 112 while being contained within the height d1 of the blind receivers 124*a* and 124*b* and a profile of the modules 120*a* and 120*b* to provide space for additional modules and beams, as shown in FIGS. 13 and 14.

In one aspect, the module 120 can have a pair of spaced-apart lateral plates 172 and 176. Each lateral plate 172 and 176 can have a larger rectangular panel 180 forming a lateral wall of the blind receiver 124 and the first perimeter collar 140, and a smaller rectangular panel 184, extending from and contiguous with the large panel 180, and forming a lateral wall of the through receiver 128 and the second perimeter collar 156. The larger and smaller rectangular panels 180 and 184 can be a single plate 172 and 176 cut or stamped from a single piece of material. A top or bottom side 188 of the smaller rectangular panel 184 can be flush with a top or bottom side 192 of the larger rectangular panel 180. In addition, the module 120 can also have a pair of spaced-apart, top and bottom, horizontal plates 196 and 200 that are vertically positioned and horizontally oriented. A top plate 196 can be coupled to a top vertical side 192 of the larger panels 180 and a bottom plate 200 can be coupled to a bottom 204 of the larger panels 180. Furthermore, the module 120 can have a pair of spaced-apart, longitudinal, vertical plates 208 and 212. A front plate 208 can be attached to a front of the smaller panels 184 and an intermediate plate 212 can be attached to the pair of lateral plates 172 and 176 between the larger and smaller panels 180 and 184. The front plate 208 can form part of the second perimeter collar 156. The intermediate plate 212 can form the abutment 136. The first perimeter collar 124 can be formed by the pair of lateral plates 172 and 176, the top plate 196 and the bottom plate 200. The second perimeter collar 128 can be formed by the pair of lateral plates 172 and 176, the front plate 208 and the intermediate plate 212.

Figure 4:
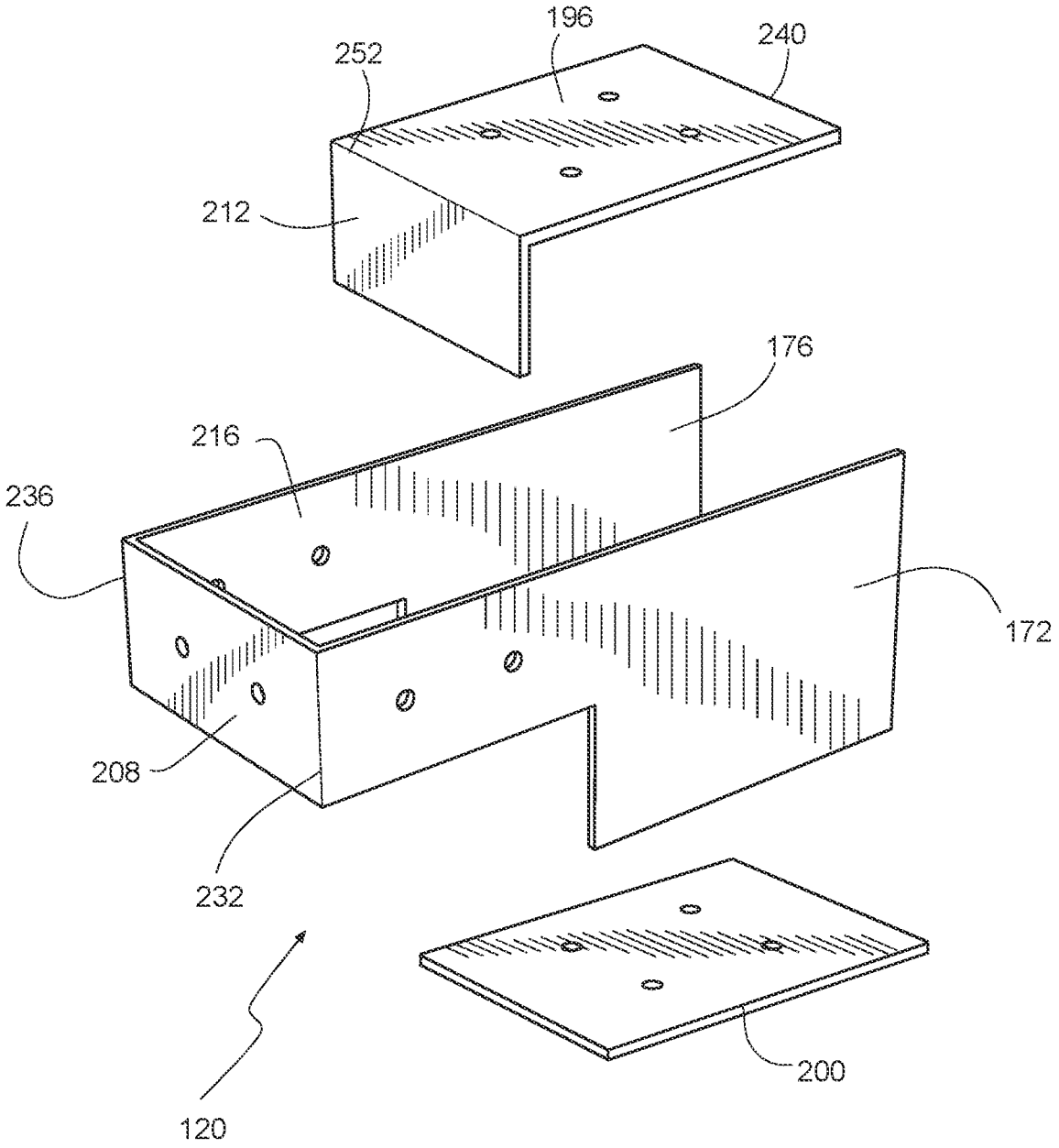
FIG. 4 is an exploded perspective view of the outdoor building module of FIG. 1.
Figure 5:
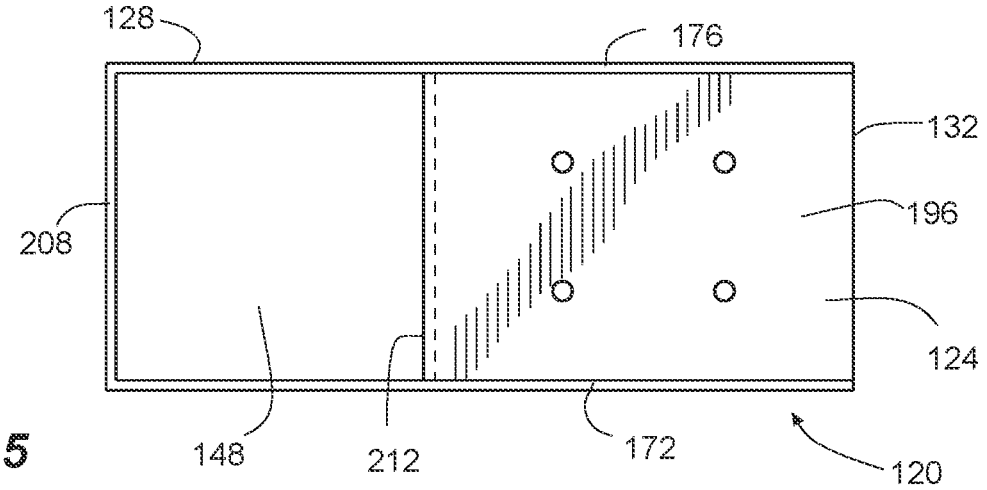
FIG. 5 is a top view of the outdoor building module of FIG. 1.
Figure 6:
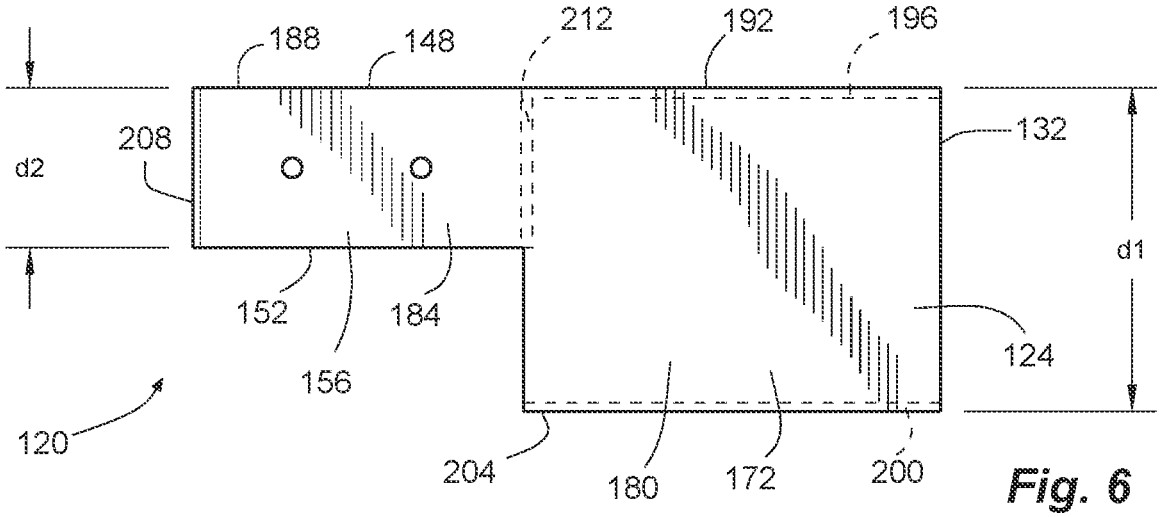
FIG. 6 is a side view of the outdoor building module of FIG. 1.
Figure 7:
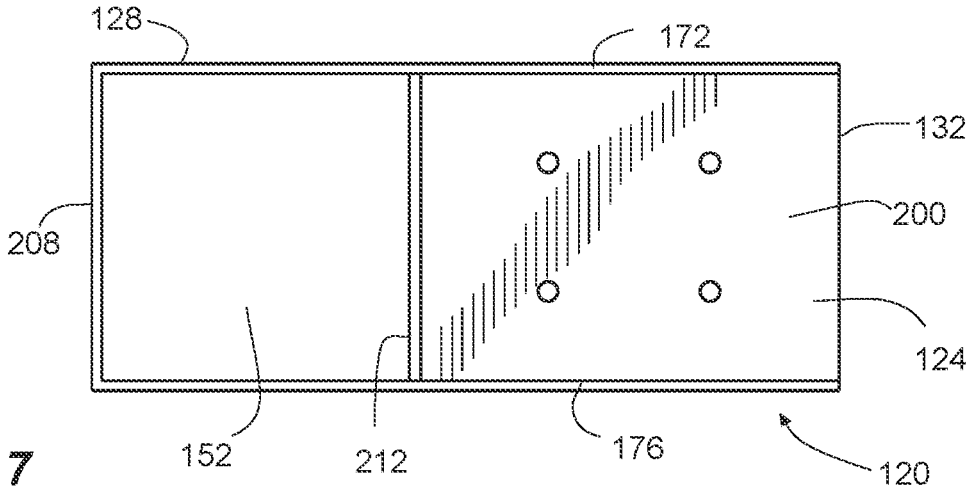
FIG. 7 is a bottom view of the outdoor building module of FIG. 1
Figure 8:
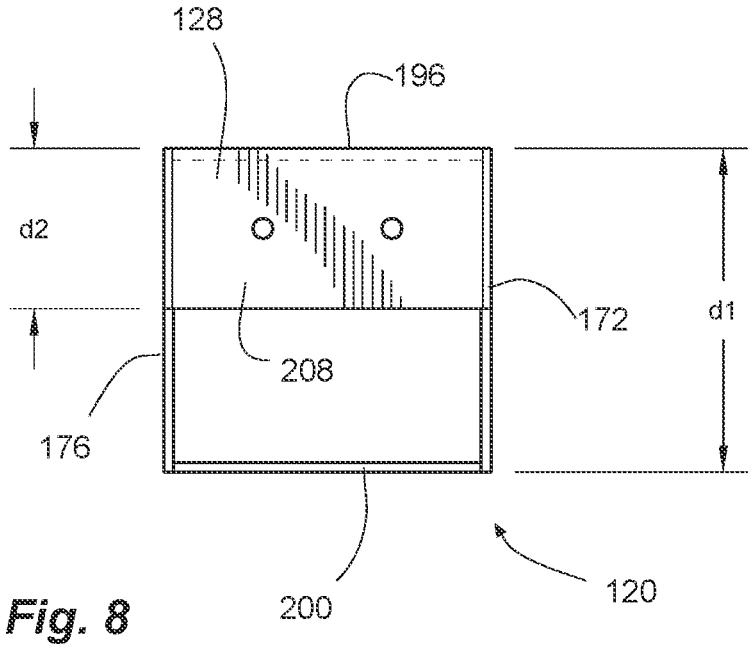
FIG. 8 is a front view of the outdoor building module of FIG. 1.
Figure 9:
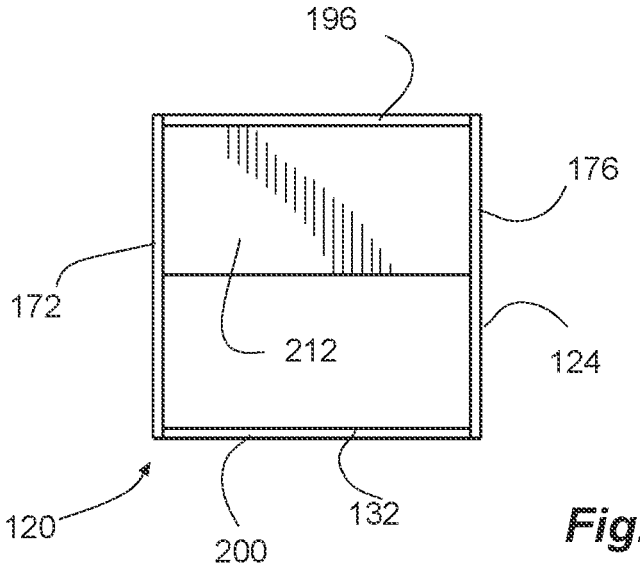
FIG. 9 is a rear view of the outdoor building module of FIG. 1.

Referring to FIG. 4, in another aspect, the module 120 can also have a first plate 216 with the pair of spaced-apart lateral plates 172 and 176 oriented parallel with one another and the front plate 208 extending between the pair of lateral plates 172 and 176. In one aspect, a pair of folds 232 and 236 can be formed between the front plate 208 and the pair of lateral plates 172 and 176. In another aspect, the front plate 208 can be welded to the pair of lateral plates 172 and 176. A second plate 240 can be attached to the first plate 216. The second plate 240 can have the top plate 196 attached between the pair of lateral plates 172 and 176 and the intermediate plate 212 attached between the pair of lateral plates 172 and 176. A fold 252 can be formed between the top and intermediate plates 196 and 212. The second plate 240 can be attached to the first plate 216 by welding the top and intermediate plates 196 and 212 to the pair of lateral plates 172 and 176. The bottom plate 200 can be attached to the first plate 216 by welding the bottom plate 200 to the pair of lateral plates 172 and 176.

Referring again to FIGS. 1 and 10, an example of the joint 100 of the outdoor framing system 104 is shown forming part of the outdoor structure 116. The joint 100 and the system 104 can utilize a pair of identical modules, including a first module 120*a* and a second module 120*b*, to connect horizontal beams 108*a* and 108*b* and a common vertical post 112. The pair of modules 120*a* and 120*b* can be oriented inverted with respect to one another. The through receiver 128*a* of the first module 120*a* can be positioned at a top of the first module 120*a*. The through receiver 128*b* of the second module 120*b* can be positioned at a bottom of the second module 120*b*. The pair of modules 120*a* and 120*b* can then be positioned with the through receivers 128*a* and 128*b* vertically aligned and with the through receiver 128*a* of the first module 120*a* positioned over the through receiver 128*b* of the second module 120*b*. The modules 120*a* and 120*b* can nest together and the through receivers 128*a* and 128*b* can abut to one another when the through receivers are vertically aligned. The common vertical post 112 can extend through both receivers 128*a* and 128*b*. The pair of modules 120*a* and 120*b* can be combined so that they are in a substantially common horizontal elevation with a substantially continuous vertical thickness between the two. The second dimension d2 of each through receiver 128*a* and 128*b* of the first and second modules 120*a* and 120*b* can be substantially half of the first dimension d1 of the blind receivers 124*a* and 124*b* to fill the thickness between the blind receivers of the modules 120*a* and 120*b*. The blind receiver 124*a* of the first module 120*a* can have an uppermost perimeter wall 260*a* and the blind receiver 124*b* of the second module 120*b* can have an uppermost perimeter wall 260*b*. The uppermost perimeter walls 260*a* and 260*b* can be substantially flush, coplanar and at a same level when coupled proximate one another on the post 112. Thus, the combined modules can conserve space and allow for further joints and modules as discussed herein.

Figure 10:
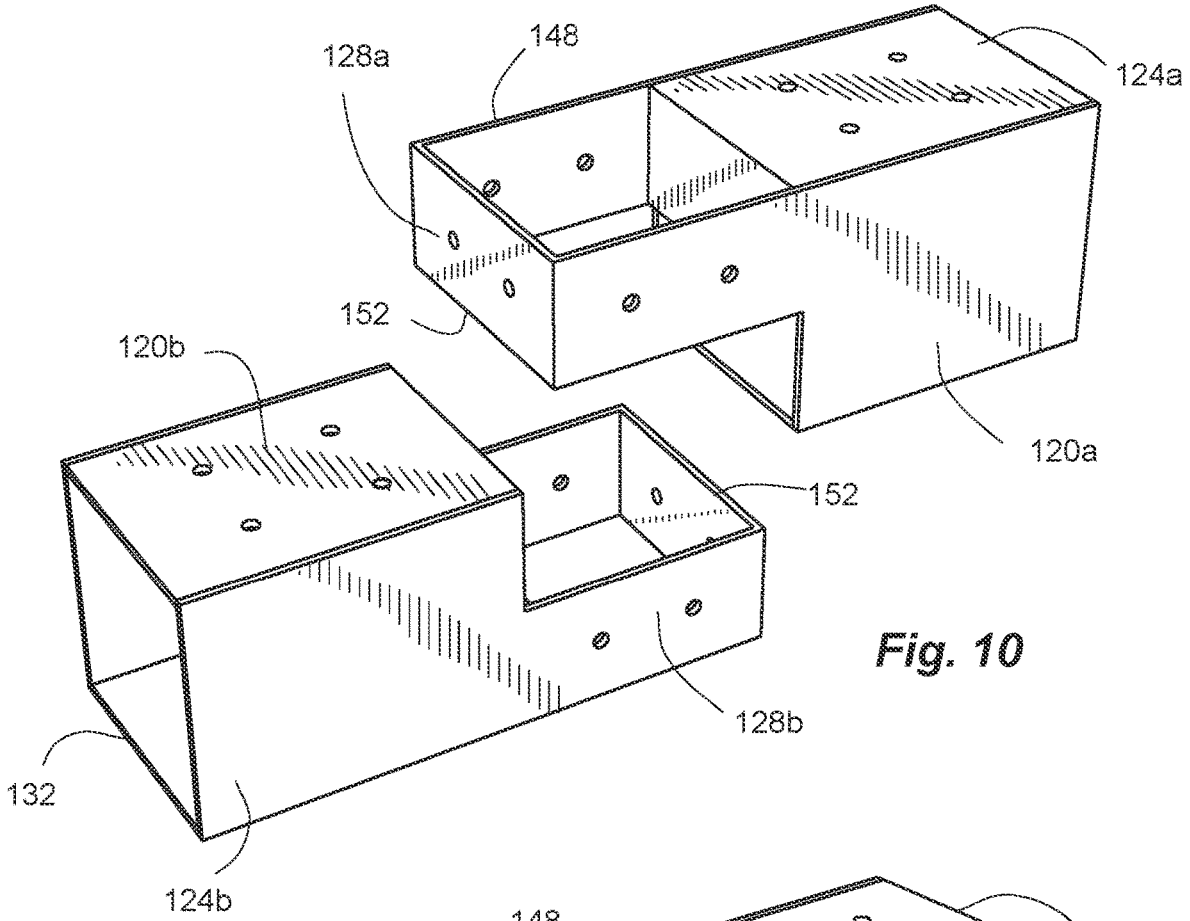
FIG. 10 is an exploded perspective of a pair of outdoor building modules of FIG. 1 shown with one module inverted with respect to the other module, and with both modules aligned.

The pair of modules can be combined in at least two different orientations, including: 1) an aligned orientation, as shown in FIG. 1, and 2) a perpendicular orientation, as shown in FIG. 10. In the aligned orientation, the horizontal axis 144*a* of the first module 120*a* can be substantially coaxial with the horizontal axis 144*b* of the second module 120*b*. The alignment orientation can be used for an intermediate joint in the outdoor structure 116.

Figure 11:
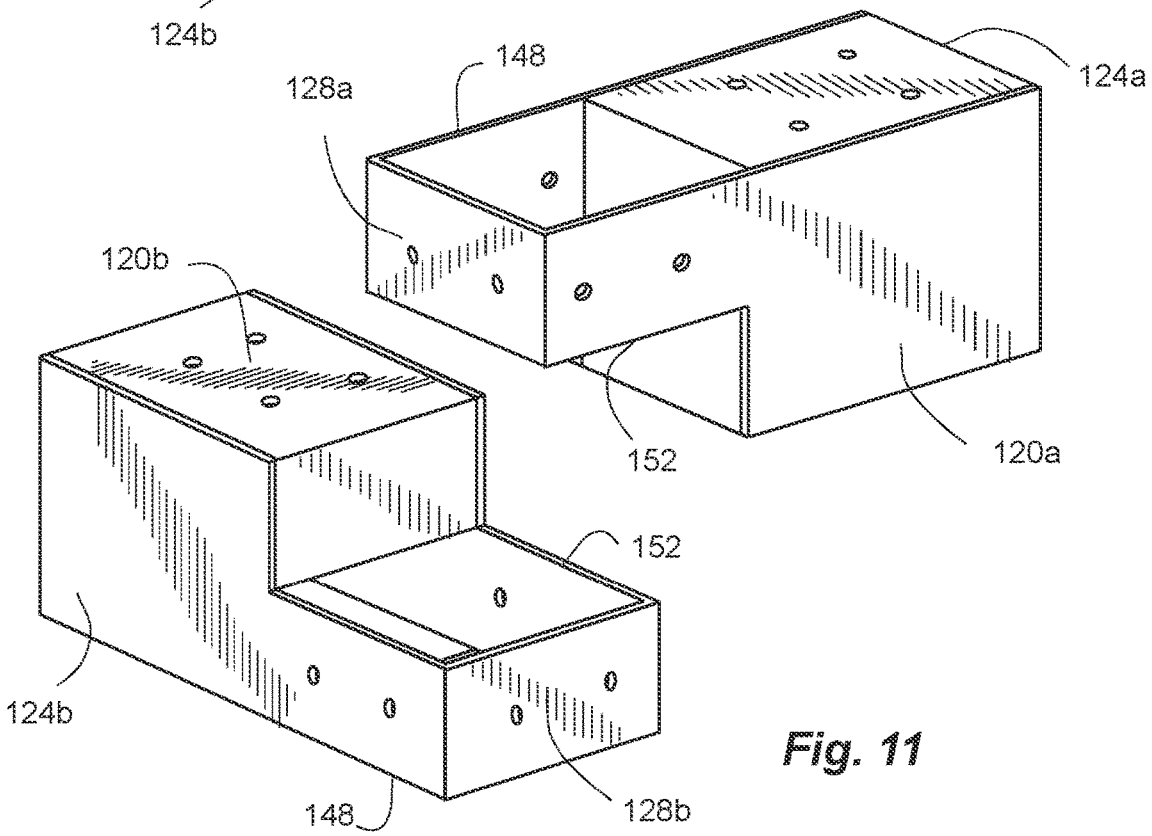
FIG. 11 is an exploded perspective of a pair of outdoor building modules of FIG. 1 shown with one module inverted with respect to the other module, and with both modules oriented perpendicular to one another.
Figure 12:
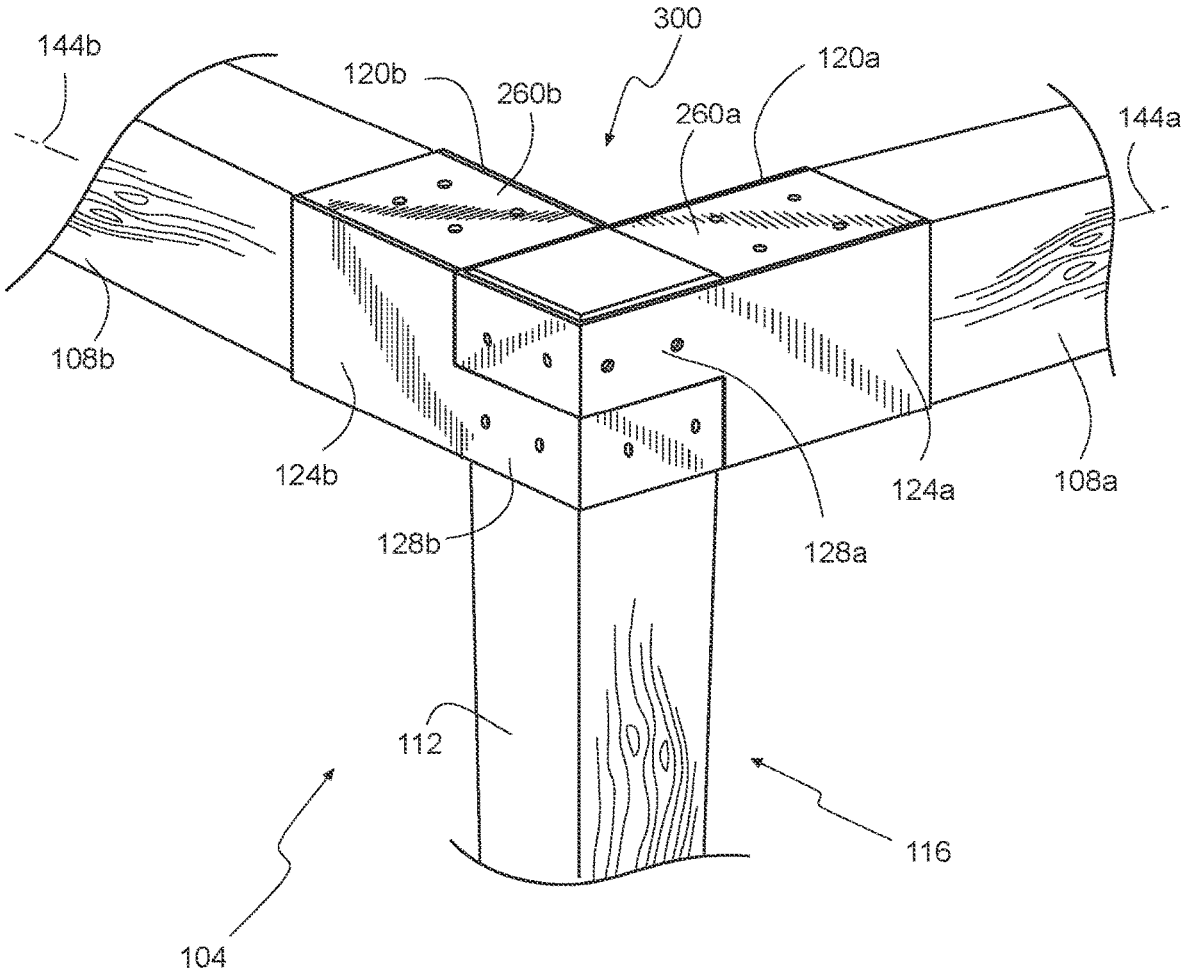
FIG. 12 is a perspective view of another joint of an outdoor structure in another embodiment of the invention showing with the pair of outdoor building modules of FIG. 1 in a perpendicular configuration.

Referring to FIGS. 11 and 12, another example of a joint 300 of the outdoor framing system 104 is shown. In the perpendicular orientation, the horizontal axis 144*a* of the first module 120*a* can be perpendicular to the horizontal axis 144*b* of the second module 120*b*. The perpendicular orientation can be used for a corner joint in the outdoor structure 116.

Referring to FIG. 13, another example of a joint 400 of the outdoor framing system 104 is shown. The joint 400 can have three modules 120*a*, 120*b* and 120*c* connecting three horizontal beams 108*a*, 108*b* and 108*c* to a common vertical post 112. Two of the modules 120*a* and 120*b* can be connected in an aligned orientation, as described herein with respect to FIG. 1. An additional third module 120*c* can be connected perpendicular to the two modules 120*a* and 120*b*. The third module 120*c* can be oriented with the second through collar 128*c* positioned at the bottom of the third module 120*c*. The two modules 120*a* and 120*c* can nest in the second through collar 128*c* of the third module 120*c* to conserve space and raise a third beam 108*c*.

Referring to FIG. 14, another example of a joint 500 of the outdoor framing system 104 is shown. The joint 500 can have four modules 120*a-d* connecting four horizontal beams 108*a-d* to the common vertical post 112. The four modules 120*a-d* can be combined into two pairs. Each of the pairs can be connected in an aligned orientation, as described herein with respect to FIG. 1. The two pairs can be oriented perpendicularly to one another. The nesting of the modules 120*a-d* in each pair reduces vertical thickness so that the joint 500 can be more compact, and the beams 108-*d* can be closer in elevation with one another.

Figure 15:
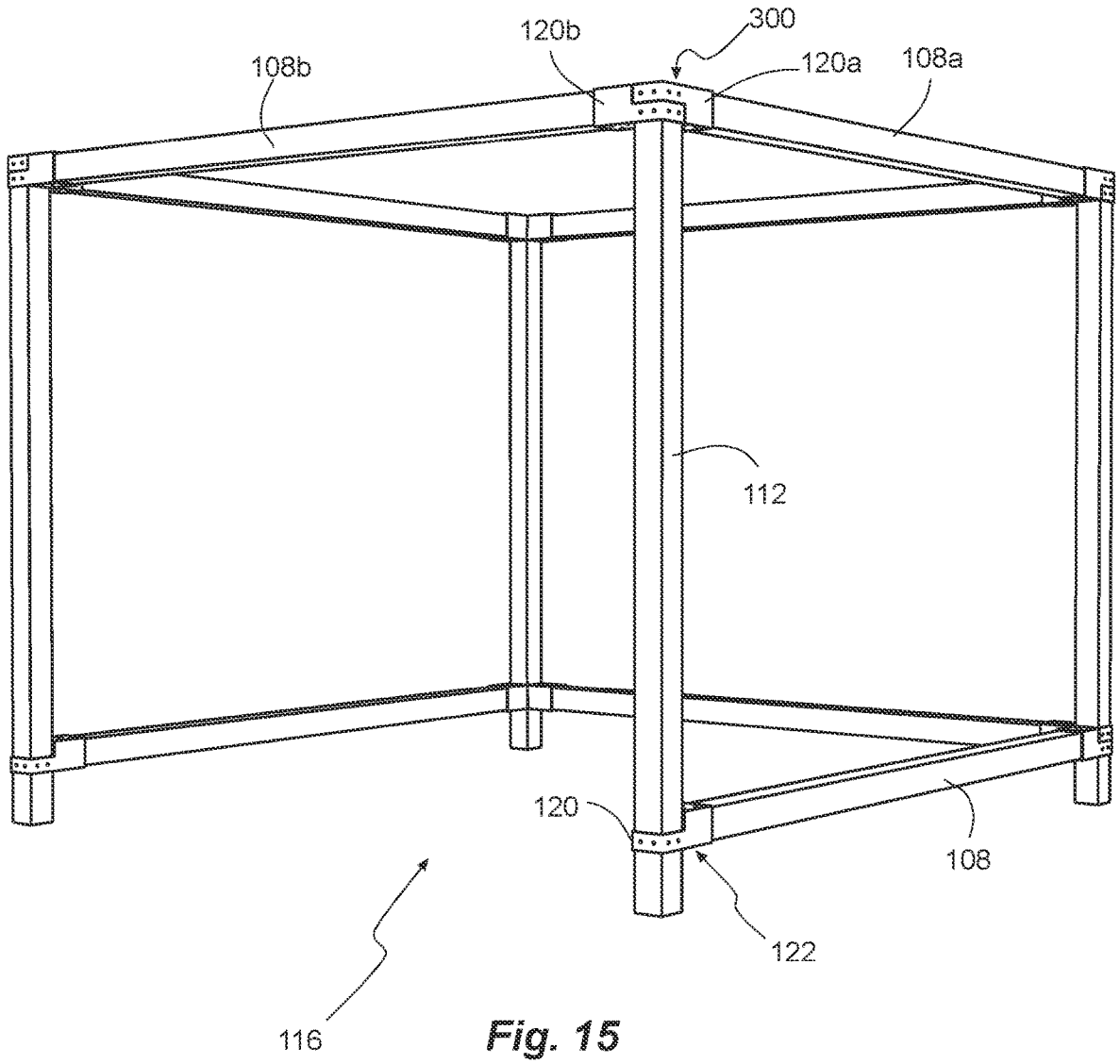
FIG. 15 is a perspective view of an outdoor structure in an embodiment of the invention.

Referring to FIG. 15, an example structure 116 is shown with joints 122 and 300 and modules 120 as described herein. In one aspect, the structure 116 can be configured as a pergola, as shown. In another aspect, the structure can be configured as a pavilion, a panel, a fence, etc. In one aspect, the posts 112 and the beams 108 can be lumber. In another aspect, the posts and the beams can be another material, such as metal.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. An outdoor framing module configured to connect a beam to a post in a perpendicular orientation, the module comprising:

a pair of receivers directly affixed to one another and oriented perpendicular to one another, the pair of receivers defining a single unified body configured to receive the beam and the post, and the pair of receivers comprising:

a first blind receiver configured to capture an end of the beam and having a first opening, a terminus spaced-apart from and opposite the first opening, a first perimeter collar extending between the terminus and the first opening and at least partially around the first opening, and a first vertical dimension across the first collar; and a second through receiver directly affixed to the first blind receiver and configured to capture the post, the second through receiver having opposite second and third openings spaced-apart from one another, a second perimeter collar extending at least partially around a periphery of the second through receiver between the second and third openings, and a second vertical dimension between the second and third openings and parallel with the first dimension;

the second dimension being less than the first dimension;

the second opening being positioned flush with a side of the first perimeter collar of the first blind receiver; and the third opening being positioned intermediate opposite sides of the first perimeter collar of the first blind receiver.

2. The module in accordance with claim 1, further comprising:

a longitudinal thickness between the second and third openings of the second through receiver being less than a vertical thickness across the first opening of the first blind receiver.

3. The module in accordance with claim 1, further comprising:

the first perimeter collar of the blind receiver being continuous around a circumference of the blind receiver; and the opening of the first blind receiver being planar.

4. The module in accordance with claim 1, further comprising:

the second perimeter collar of the second through receiver being continuous around a circumference of the second through receiver.

5. The module in accordance with claim 1, further comprising:

the second and third openings of the second through receiver being planar; and the second and third openings of the second through receiver being oriented parallel with respect to one another.

6. The module in accordance with claim 1, further comprising:

the second vertical dimension of the second through receiver being substantially half of the first vertical dimension of the first blind receiver.

7. The module in accordance with claim 1, wherein the module is a first module and further comprising:

a second identical module identical to the first module and defining a pair of modules configured to be coupled to a common post;

the first and second modules being oriented inverted with respect to one another with the through receiver of the first module positioned at a top of the first module and the through receiver of the second module positioned at a bottom of the second module;

the first and second of modules being positioned with the through receivers vertically aligned and with the through receiver of the first module positioned over the through receiver of the second module; and the first and second modules combinable in a substantially common horizontal elevation with a substantially continuous vertical thickness.

8. The module in accordance with claim 1, further comprising:

a pair of spaced-apart lateral plates each comprising:

a larger rectangular panel forming a lateral wall of the first blind receiver;

a smaller rectangular panel extending from the larger panel and forming a lateral wall of the second through receiver; and a vertical side of the smaller rectangular panel being contiguous with a vertical side of the larger rectangular panel.

9. The module in accordance with claim 8, further comprising:

a pair of spaced-apart horizontal plates including a top plate coupled to the top of the larger panel and a bottom plate coupled to a bottom of the larger panel; and a pair of spaced apart longitudinal vertical plates including a front plate attached to a front of the smaller panels and an intermediate plate attached to the pair of lateral plates between the larger and smaller panels.

10. An outdoor framing system configured to connect beams and a common post into an outdoor structure, the system comprising:

at least two identical modules including a first module and a second module configured to be coupled to the common post, each module comprising:

a blind receiver with an opening, a terminus spaced-apart from and opposite the opening, a perimeter collar extending between the terminus and the opening, a horizontal axis, and a first vertical dimension across the perimeter collar; and a vertical through receiver directly affixed to the blind receiver and having opposite vertical openings spaced-apart from one another, a perimeter collar extending between the opposite vertical openings, a vertical axis through the opposite vertical openings and perpendicular to the horizontal axis of the blind receiver, a second vertical dimension between the opposite vertical openings and parallel with the first vertical dimension, the second vertical dimension being less than the first vertical dimension, one of the opposite vertical openings being positioned flush with a side of the perimeter collar of the blind receiver, and the other opposite vertical opening being positioned intermediate opposite sides of the perimeter collar of the blind receiver;

the pair of modules being oriented inverted with respect to one another with the through receiver of the first module positioned at a top of the first module and the through receiver of the second module positioned at a bottom of the second module; and the pair of modules being positioned with the through receivers vertically aligned and with the through receiver of the first module positioned over the through receiver of the second module.

11. The system in accordance with claim 10, further comprising:

the pair of modules combinable in a substantially common horizontal elevation with a substantially continuous vertical thickness.

12. The system in accordance with claim 10, further comprising:

the blind receiver of the first module having an uppermost perimeter wall;

the blind receiver of the second module having an uppermost perimeter wall; and the uppermost perimeter walls being substantially coplanar.

13. The system in accordance with claim 10, further comprising:

the pair of modules being combinable in at least two different orientations, including:

an aligned orientation with the horizontal axis of the first module being substantially coaxial with the horizontal axis of the second module; and a perpendicular orientation with the horizontal axis of the first module being perpendicular to the horizontal axis of the second module.

14. The system in accordance with claim 10, further comprising:

the second vertical dimension of each through receiver of the first and second modules being substantially half of the first vertical dimension of the blind receivers.

15. The system in accordance with claim 10, further comprising:

the through receivers of both the first and second modules abutting to one another when vertically aligned.

16. A joint of an outdoor structure, comprising:

a vertical post;

at least two horizontal beams including first and second horizontal beams with ends coupled to the vertical posts at a common location;

at least two identical modules coupling the at least two horizontal beams to the vertical post, and including a first module coupled to the end of the first horizontal beam and a second module coupled to the end of the second horizontal beam, each module comprising:

a horizontal blind receiver with an opening, a terminus spaced-apart from and opposite the opening, a perimeter collar extending between the terminus and the opening, a horizontal axis extending between the terminus and the opening, and a first vertical dimension across the perimeter collar; and a vertical through receiver directly affixed to the blind receiver and having opposite vertical openings spaced-apart from one another, a perimeter collar extending between the vertical openings, a vertical axis through the vertical openings perpendicular to the horizontal axis of the blind receiver, a second vertical dimension between the opposite vertical openings, the second vertical dimension being less than the first vertical dimension, one of the opposite vertical openings being positioned flush with a side of the perimeter collar of the blind receiver, and the other opposite vertical opening being positioned intermediate the opposite sides of the perimeter collar of the blind receiver;

the at least two identical modules being oriented vertically inverse with respect to one another with the first module oriented with the through receiver positioned at a top of the first module and the second module oriented with the through receiver positioned at a bottom of the second module;

the at least two matching modules being positioned with the through receivers being vertically aligned; and the vertical post received in and secured to both through receivers of the first and second modules.

17. The joint in accordance with claim 16, further comprising:

the pair of modules having a substantially common horizontal elevation with a substantially continuous vertical thickness.

18. The joint in accordance with claim 16, further comprising:

the blind receiver of the first module having an uppermost perimeter wall;

the blind receiver of the second module having an uppermost perimeter wall; and the uppermost perimeter walls being substantially coplanar.

19. The joint in accordance with claim 16, further comprising:

the pair of modules being horizontally aligned with the horizontal axis of the first module being substantially coaxial with the horizontal axis of the second module.

20. The joint in accordance with claim 16, further comprising:

the pair of modules being oriented perpendicularly with respect to one another with the horizontal axis of the first module being perpendicular to the horizontal axis of the second module.

* * * * *